US006253825B1

(12) United States Patent
Pettersson et al.

(10) Patent No.: US 6,253,825 B1
(45) **Date of Patent: *Jul. 3, 2001**

(54) DEVICE IN DOOR ARRANGEMENTS

(75) Inventors: Jan-Erik Pettersson, Sävedalen; Mats Eriksson, Strömstad, both of (SE)

(73) Assignee: Cardo Door AB (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/493,501

(22) Filed: Jan. 28, 2000

Related U.S. Application Data

(62) Division of application No. 08/981,696, filed as application No. PCT/SE96/00871 on Jul. 1, 1996.

(30) Foreign Application Priority Data

Jul. 5, 1995 (SE) ..... 9502433

(51) Int. Cl.[7] ..... E05D 15/16
(52) U.S. Cl. ..... 160/201; 160/229.1; 160/40
(58) Field of Search ..... 160/201, 235, 160/263, 133, 229.1, 40

(56) References Cited

U.S. PATENT DOCUMENTS 3,648,755 * 3/1972 Thiele ..... 160/201
5,474,118 * 12/1995 Hoffmann ..... 160/235

FOREIGN PATENT DOCUMENTS

623724 * 11/1994 (EP) .
464822 * 6/1991 (SE) .

* cited by examiner

*Primary Examiner*—Blair M. Johnson
(74) *Attorney, Agent, or Firm*—Orum & Roth

(57) ABSTRACT

A device in door arrangements includes a plurality of door panels hingedly interconnected to pivot about respective pivot axes. The pivot axes are positioned Between the side walls of contacting door panels. The hinge includes a convex member and a concave member, the concave member forming part of the other door panel. These two members extend along the edges of the corresponding door panels, coinciding with the pivot axis, with each member collectively forming a bearing face. Each door panel has a main profile extending uninterrupted over the entire cross section, and the edge of the door panel exhibits a curved section extending in the thickness direction. Further, each door panel has rigidifying portions arranged in the edge area.

7 Claims, 12 Drawing Sheets

DEVICE IN DOOR ARRANGEMENTS

This application is a division of Ser. No. 08/981,696, filed Dec. 17, 1998, and a 371 of PCT/SE96/00871 filed Jul. 1, 1996.

BACKGROUND OF THE INVENTION

Field of the Invention

The present invention relates generally to an arrangement in doors and more specifically to doors constructed to avoid the risks of injuries caused by squeezing or crushing.

In door arrangements of this kind it is common practice to arrange for instance guide tracks extending vertically on either side of an opening in a building wall. The guide tracks extend adjacent or above the opening, via a curved portion, preferably horizontally further into the building. When the door traverses the curved portion a gap forms between neighouring door panels as the latter are being rotated relatively to one another. The gaps are a potential crushing injury hazard. It is already known to use various devices to lessen such hazards.

EP Patent 0 326 131 discloses one example of a anti-squeezing-injury joint comprising several hinges disposed along a pivot axis positioned in the vicinity of a lateral face of two neighboring door panels. Neighboring door panels have one convex and one concave member which are in contact with one another only when the door panels extend in parallel. As the panels are being rotated relatively to one another, a narrow gap forms between them. In order to avoid squeezing-injury hazards in the area of the hinges upon mutual rotation of the door panels, specially designed guards are positioned adjacent the hinges.

Disadvantages common to all devices of the type outlined above is that the convex/concave members are not made use of as supporting faces when the neighbouring door panels are being rotated relatively to one another. As a result, the hinges must absorb all stress exerted during the turning movement, and consequently a number of hinges must be positioned along the pivot axis in order to produce a safe and durable door. In turn, this arrangement leads to more expensive doors comprising an increased number of parts. Doors of this kind are also difficult and time-consuming to mount because of the number of hinges. Because the hinges are located on the inner face of the door panels doors of this kind also require that a particular crushing-injury guard is positioned in the area of the hinge, which further affects the costs and the complex nature of the product negatively. In addition, dirt and moisture could collect in the minor gaps formed when adjacent door panels are being rotated relatively to one another.

In the Danish Patent Application No 0436 93 is disclosed another crushing injury guard hinge according to which adjacent door panels are formed with one convex and one concave member. In this case, the pivot axis is located between the lateral faces of the door panels. The convex and concave members are in engagement during the entire rotational movement, thus forming a bearing face on which the hinge may be supported. In this case, pivot pins are provided at the ends or neighboring door panels, locking them to one another. In addition, the hinge is provided with guide means on the inner face of the door panels, along the hinge. The guides are adapted to stiffen the construction so as to prevent the neighbouring door panels from being displaced relatively to one another in an area spaced from the hinges.

A problem found with this construction is that the guides make the construction more expensive and in addition difficult and time-consuming to mount. Furthermore, the guides occupy space on the inner face of the door and since they project beyond the lateral face of the door on the inner face thereof they are sensitive to impacts. In addition, they are configured with sharp and pointed edges which may be the cause of injuries.

A low-friction slide rail is provided at least on one of the members. In accordance with the drawings, the slide rail is positioned on the concave member. Wear-induced damages, such as scratches, discolorings and the like, may form on the convex member after some time of use. Since this member is not exchangeable the entire door panel must be replaced if one wants to prevent the wear damages from being visible when the door panels are being rotated relatively to one another.

Furthermore, at least one of the members is formed with a resilient sealing strip. The provision of separate slide rails and sealing strips involves the use of several parts, which in turn means that an increased number of pieces need to be kept in store and that a larger amount of components need to be handled when the door is being manufactured. In addition, the number of attachment points to secure the rails and the strips is increased.

In this prior-art device the rollers are arranged on the inner face of the door, spaced from the pivot axis. In an arrangement of this nature the guide tracks normally extend at an angle to the lower part of the opening in which they are attached. In this manner, the rollers force the door towards the opening in the lower position of the door, providing a sealing effect. An, arrangement of this kind requires numerous parts, increases the stress on the door panels in the area of the hinges, is difficult to mount and increases the maintenance and repairs, all of which in combination leads to an expensive door construction.

The Swedish Patent Specification No 8901857-6 discloses another example of a crushing-injury preventing hinge. Also in this case, neighboring panels are formed with one convex and one concave member which are snap-fitted one into the other. The pivot axis of this device is positioned between the lateral walls of the door panels and the concave and the convex members of adjacent door panels engage during the entire rotational movement and thus are used as bearing faces. In this case, the door panels are manufactured entirely from injection-moulded plastics, a method necessitating large and expensive molds and producing panels having a rigidity that make them particularly suitable for closure of comparatively small-size openings. On account of the snap fit between the convex and the concave members a high degree of manufacturing accuracy is required and it also involves risks that the concave member will crack when being snapped onto the convex member. The door panels are manufactured as one single piece, with the result that the wear faces between the convex and the concave members are not replaceable separately. Furthermore, no sealing strip is arranged on the outer face of contacting door panels along the hinge. As a result, moisture and dirt may enter into the hinge, particularly when the external face of the door is exposed to heavy wind loads.

SUMMARY OF THE INVENTION

In the light of the above situation it is an object of the present invention to remove the above disadvantages and to provide a device in door arrangements wherein injuries caused by crushing have been eliminated. A further object of the subject invention is to provide a device in door arrangements which as a whole is cost-efficient to manufacture and easy to mount. A further object of the present invention is to provide a device in door arrangements comprising only a small number of parts. In addition, a further object of the present invention is to provide a device in door arrangements wherein the parts may be easily separated and the material thus be recycled.

BRIEF DESCRIPTION OF THE DRAWINGS

In the following, at presently preferred embodiments of the present invention will be described in more detail with reference to the accompanying drawings, wherein.

DESCRIPTION OF THE PREFERRED EMBODIMENT

Figure 1:
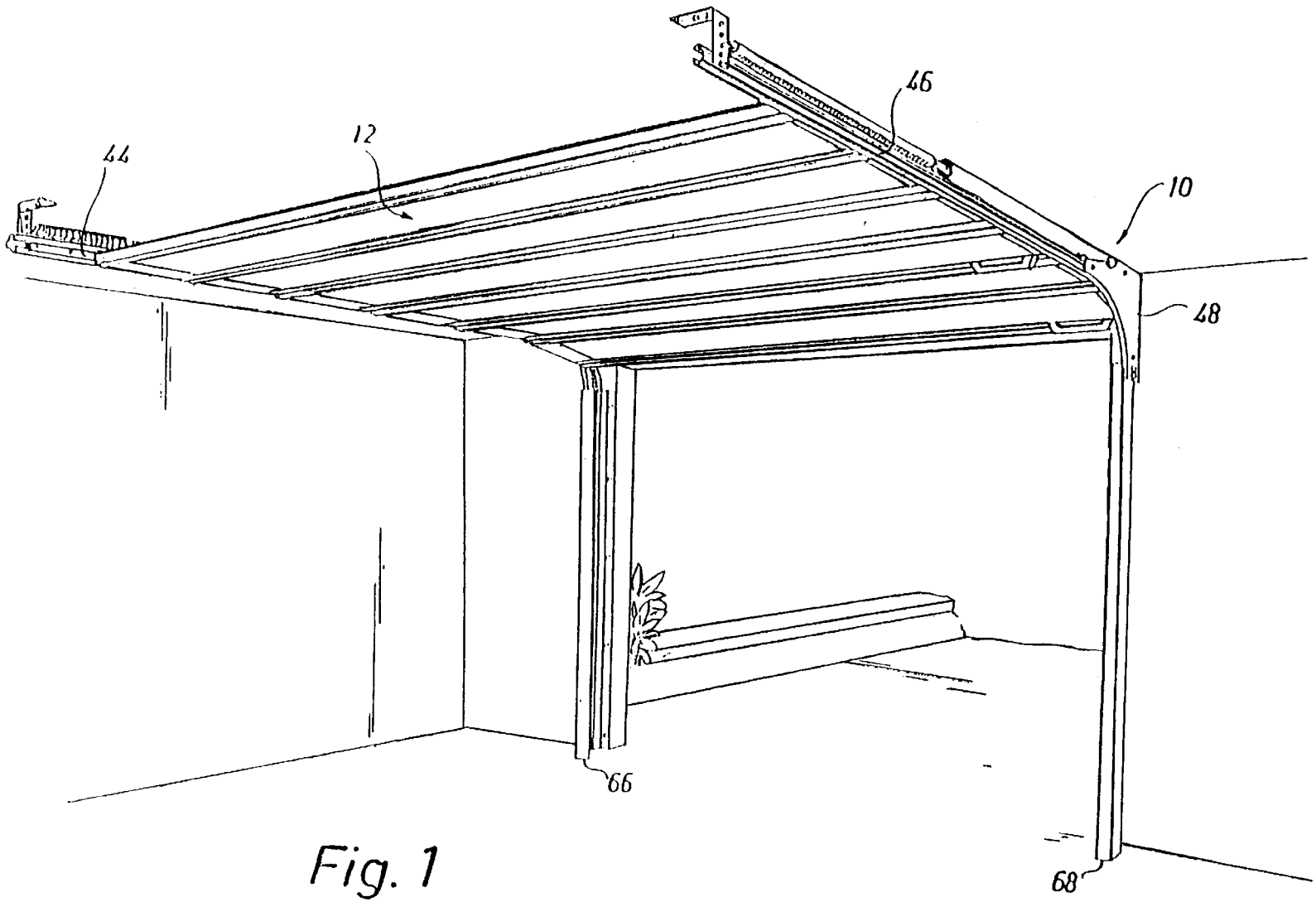
FIG. 1 shows one example of a door in connection with which the inventive device may be used.

The device in accordance with the invention is used for instance in door arrangements of the kind designated generally by numeral reference 10 in FIG. 1. The door of the type shown in this drawing figure comprises a plurality of door panels, generally designated by numeral reference 12, which are hingedly interconnected along their edges, generally indicated by numeral references 14, 16 (see FIG. 2).

Figure 2:
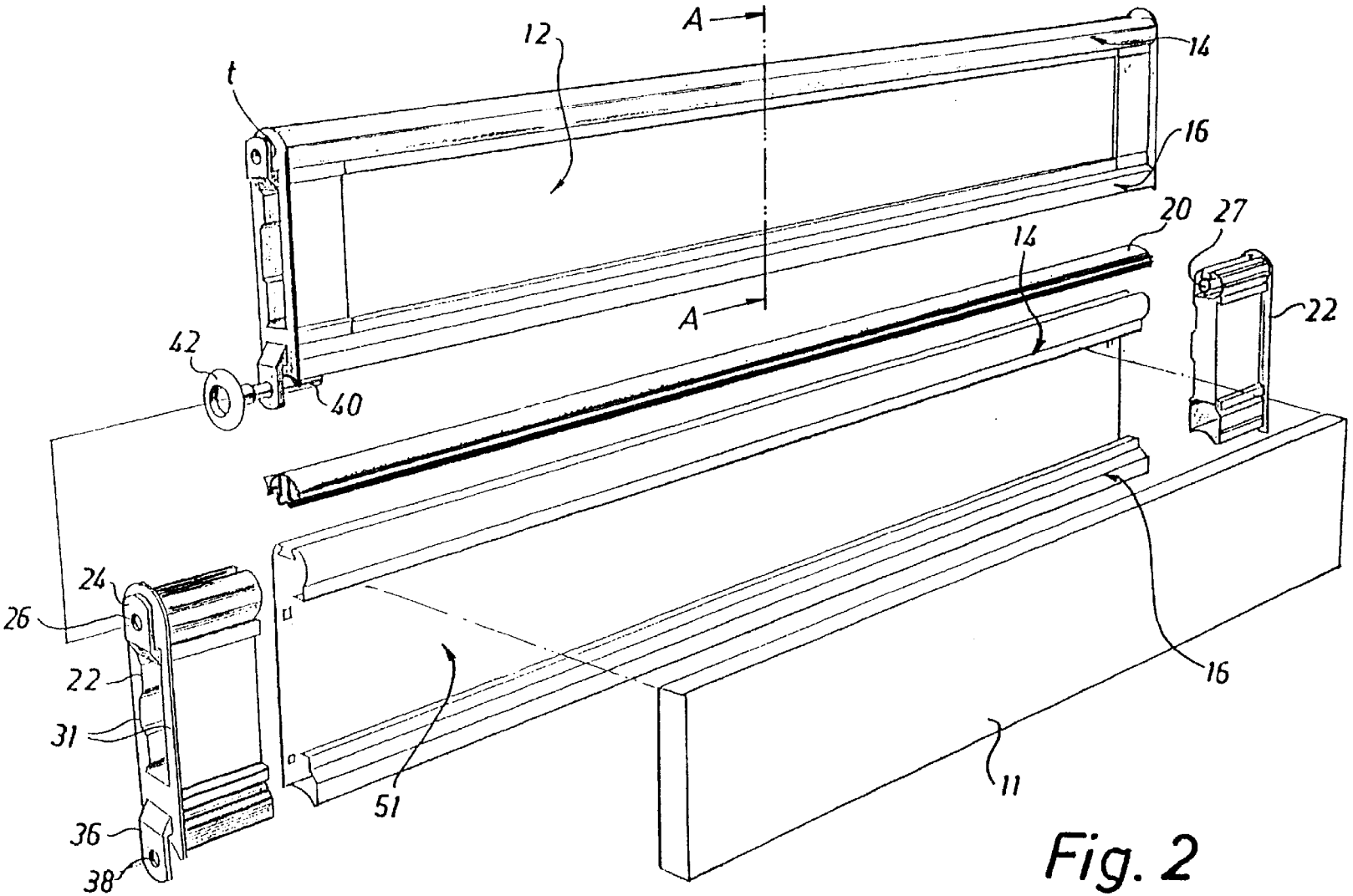
FIG. 2 is an explosive view of one embodiment of the inventive device.
Figure 3:
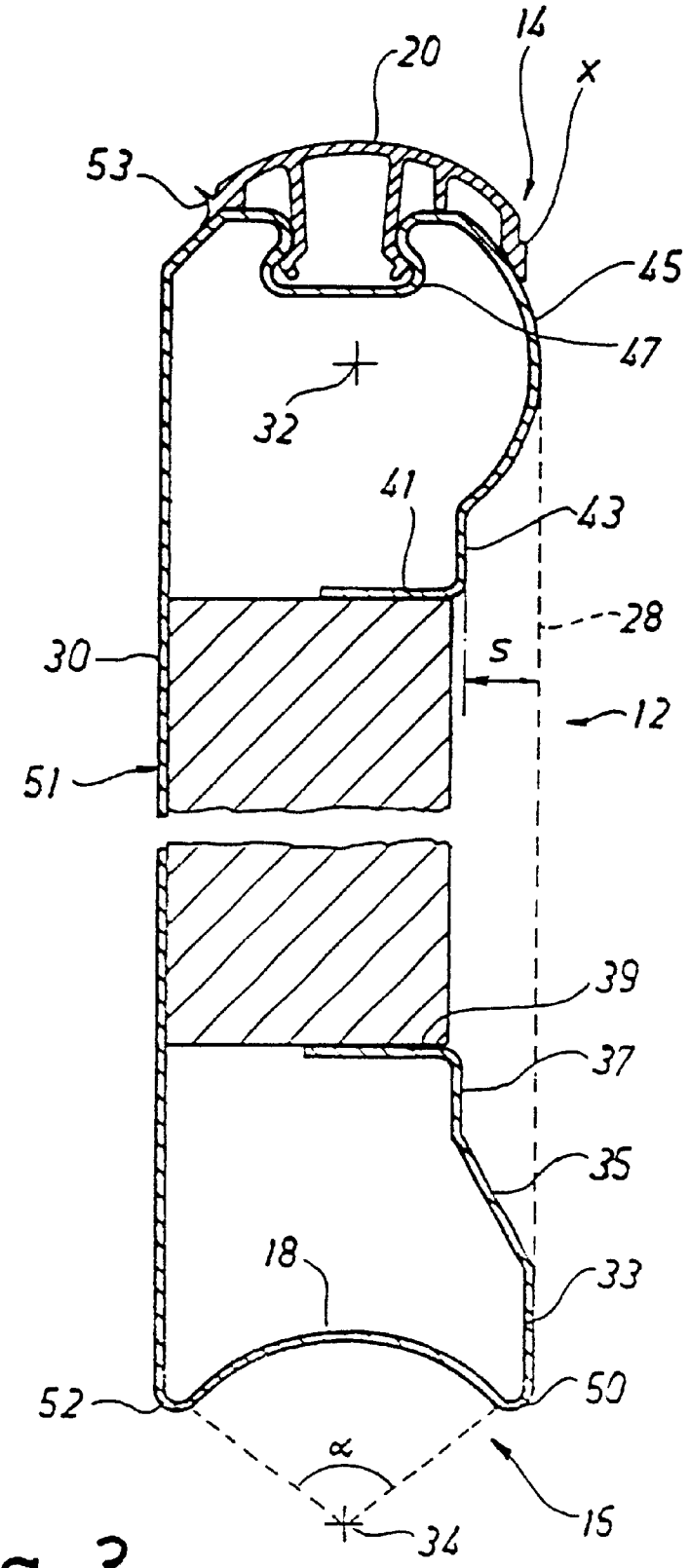
FIG. 3 is a sectional view as seen along lines A—A in FIG. 2.
Figure 4:
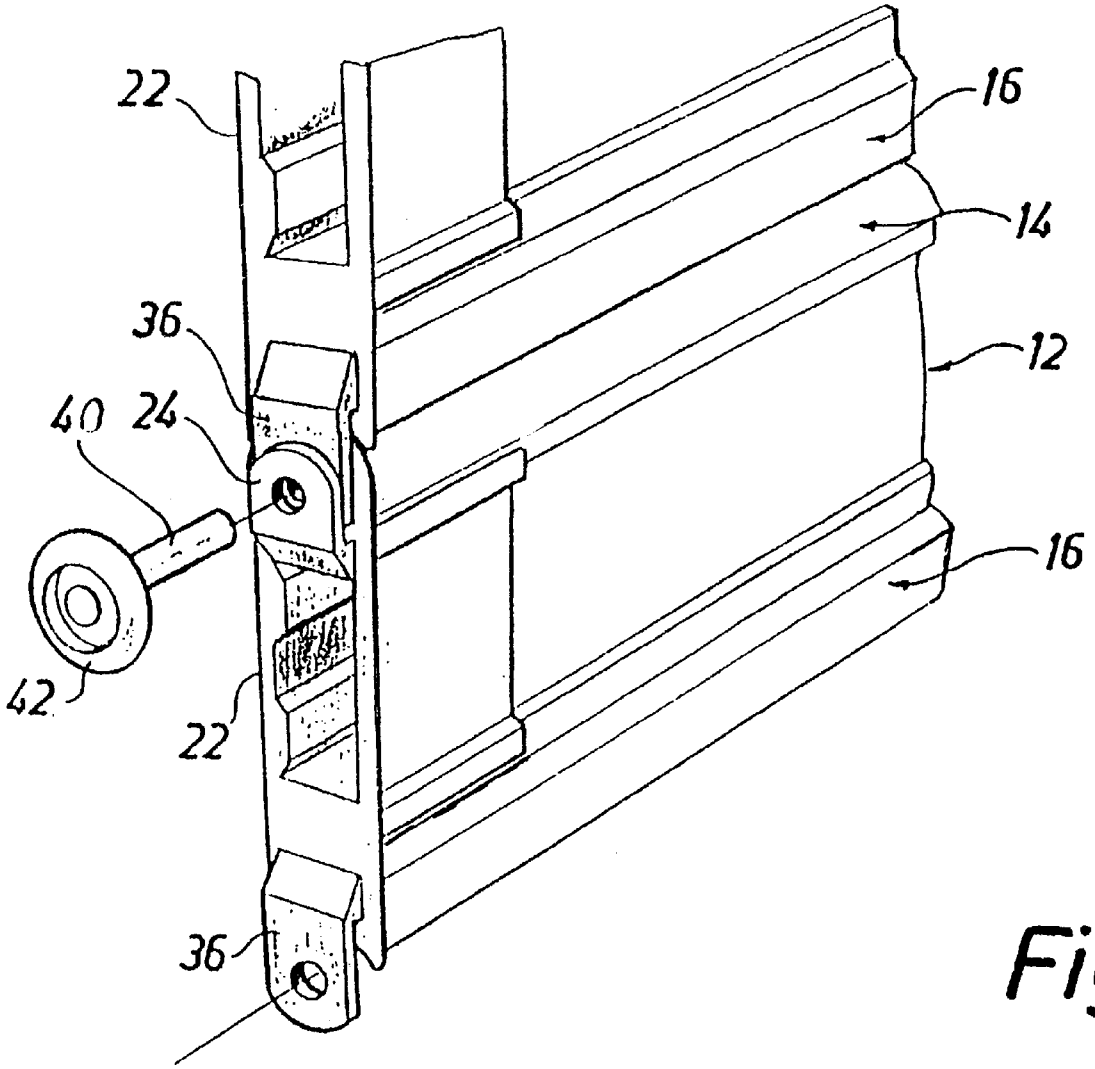
FIG. 4 illustrates the interconnection of neighbouring door panels according to the embodiment of FIG. 2.

As appears from FIGS. 2–3 the very edges 16, 14 comprise, according to a first embodiment, respectively a concave member 18 and a convex member 20, which members extend lengthwise along the entire panel. Over at least part of their extension the concave member 18 and the convex member 20 have a mutually complementary configuration for reasons that will appear further on. The concave member 18 extends, in cross-section, through a curvature angle $\alpha$ of less than 180° for reasons that will appear further on. The curvature angle a is illustrated in FIG. 3 by means of dashed lines.

In accordance with the embodiment of FIGS. 1–4 a door panel 12 comprises one convex member 20 and one concave member 18, each at its respective one of edges 14, 16. They are arranged in vertical alignment. Accordingly, all door panels 12 are of equal configuration, providing the advantages that will appear further on. The axis 32 of the concave member 20 extends in the longitudinal direction of the entire door panel. Also the concave member 18 has an axis 34 which also extends in the lengthwise direction of the entire door panel, in parallel with axis 32.

Each door panel has a closed side wall 30 and in accordance with a first embodiment, illustrated by dashed lines, at least a partly open side wall 28. The closed side wall 30 forms the external side of the door panel.

At each end the open wall 28 is formed with a plurality of portions 33, 35, 37, 39, 41, 43, 45 which extend in the longitudinal direction of the entire door panel and which are continuously interconnected with respectively the concave member 18 and the convex member 20. These portions 33, 35, 37, 39, 41, 43, 45 have a rigidifying effect on the door panel.

In the area of the convex member 20 the edge 14 is formed with a groove, preferably of dove-tail configuration, extending in the lengthwise direction of the entire door panel.

As appears from the cross-sectional view of FIG. 3 the convex member 20 is a separate part which is snap-fitted into the groove 47. As also appears from this cross-sectional view, the door panel is formed as a closed profile section along edge 14. The convex member 20 is manufactured from a material which preferably is a low-friction plastics material. The convex member 20 is formed with a resilient sealing lip 53 in the area of the external face 30 of the door panel, in sealing contact with the edge 14 and edge 16 of a door panel above, when neighbouring panels are parallel. The convex member 20 formed with the sealing lip 53 preferably is manufactured by co-extrusion.

In accordance with the embodiment of FIG. 2 each door panel 20 is formed with end pieces 22 at each end. The end pieces 22, preferably injection-molded from low-friction plastics, preferably reattached to the associated door panel 12 by means of snap connections (not shown), as appears from the upper art of FIG. 2.

The end piece 22 has a configuration matching that of the main profile section of the door panel, generally referenced by 51, and it is inserted into the door panel end, into contact with the rigidifying sections 33, 35, 37, 39, 41, 43, 45, the inner ace of edges 14, 16, the inner face of groove 47 and the inner face of the side wall 30. In accordance with one embodiment (not shown) each end piece 22 is formed with at least one depression at least in an area contacting the door panel 12. When the end piece 22 has been pusher into the door panel end, the door panel is subjected to a stamping operation in the area of the depression, whereby a bead is formed in the door panel, which bead at least partly is seated in the depression. In this manner the joint between the end piece and the door panel is further reinforced. Preferably, the stamped configurations are formed in the bottom of groove 47 and/or the bottom of the concave member 18, with said depressions being arranged in the corresponding areas of the end piece.

In the area of the edge 14 the end piece 22 is formed with a lug 24 having a recess 26 formed therein. In accordance with the preferred embodiment this recess 26 is positioned intermediate the sides 28, 30 of the door panel 12. The center axis of recess 26, which preferably is a round hole, coincides with axis 32.

In the area below the edge 16, the end piece 22 is formed with a lug 36 having recess 38. The center axis of the recess 38, which preferably is a round hole, coincides with axis 34.

When the adjoining door panels 12 are assembled into he door of the kind illustrated in FIG. 1 the convex member 20 abuts against the corresponding concave member 18. Thus, the axes 32, 34 of the members 18, 20 coincide. In this position, the lugs 24, 36 of the end pieces 22 of neighbouring door panels are positioned in such a manner that the holes 26, 38 are placed on the common axis 32, 34.

In order to lock neighbouring door panels in this position against rotation a pivot shaft 40 is positioned in the holes 26, 38 of the end pieces 22. The pivot shaft 40, which preferably is made from metal, is prolonged to extend along the common axis 32, 34 and projects into the end piece 22 in the area of the edge 14 in a recess 27. The pivot shaft is rotatably mounted at least in one of the holes 26, 23 and preferably also in the recess 27. In this case the neighboring end pieces 22, the lugs 24, 36 the holes 26, 27, 38 therein and the pivot shaft 40 together form a locking means. Such locking means are positioned in pairs along the ends of the door sections.

At the end of the pivot shaft 40 facing away from the door panels a roller 42 is arranged in a centered and preferably rotatable condition. The rollers 42 are guided by guide tracks 44, 46 extending along the intended path of movement of the door (see FIG. 1) to travel in said tracks. In a manner known per se one or several wires (not shown) are arranged in the lower or upper edge of the door and, in a manner also known per se, they are arranged to be connected to weight-supporting and/or balancing means. A motor (not shown) may by means of one or several interconnections means (not shown), such as wires, be connected to the uppermost door panel. The motor transfers tractive forces to the interconnection means and is used to raise and lower the door. Because of the provision of the lugs 24, 36 being interconnected by means of at least one web member 31 in each end piece 22, thus serving as tractive-forces absorbing means, and because the end pieces 22 are continuously interconnected by the lugs 24, 36, the holes 26, 27, 28 and the pivot shaft 40 along each end of the door, tractive forces generated by the motor in combination with the dead weight of the door may be taken by, the end pieces 22.

When neighboring door panels are displaced manually or mechanically across a curvature 48 in the aide tracks 44, 46 they are being rotated relatively to one another along a pivot axis coinciding with the abovementioned common axis 32, 34. Thus, neighbouring door panels will be retained in position by the rollers 42 and the pivot shafts 40 in combination with the shape given to the concave member 18, causing the latter to abut against the convex member 20. Consequently, the convex member 20 and the concave member 18 of neighboring door panels form bearing faces controlling, together with the rollers 42 and the pivot shafts 40, the rotational movement along the pivot axis 32, 34.

The rigidifying portion 45 is a cylindrical face having the same axis 32 as the convex member 20. The rigidifying portion 43 is recessed over a distance s in the main profile section 51. The bearing face of the convex member 20 extends along a radius which, calculated from the axis 32, somewhat exceeds the radius along which the rigidifying portion 45 is arranged. This is illustrated by the provision on the convex member of an upper edge positioned at a small distance x (see FIG. 3) from the section 45. When neighboring door panels are being rotated relatively to one another an external part of the concave member 18 will abut against the corresponding convex member 20, an inner part of said member 18 being spaced only slightly from the portion 45. The spacing is so minute that the risks of crushing injuries are avoided. Because portion 43 is recessed by distance s neighbouring door panels are allowed to turn relatively to one another through an angle which preferably amounts to 45°.

The convex member 20 preferably is positioned above the concave member 18 when the door panels assume a vertical position. In this manner moisture and dirt that have penetrate past the sealing lip 53 are prevented from collecting in the concave member 18.

Instead of the convex member 20 a top seal (not Ad shown) may be received with a snap-fit in the groove 47 of the uppermost door panel, said lip sealing against the wall in the lower, closed position of the door. In a corresponding manner a bottom seal may be attached to the concave member 18 of the lowermost door panel to seal against the floor when the door is closed.

Figure 8:
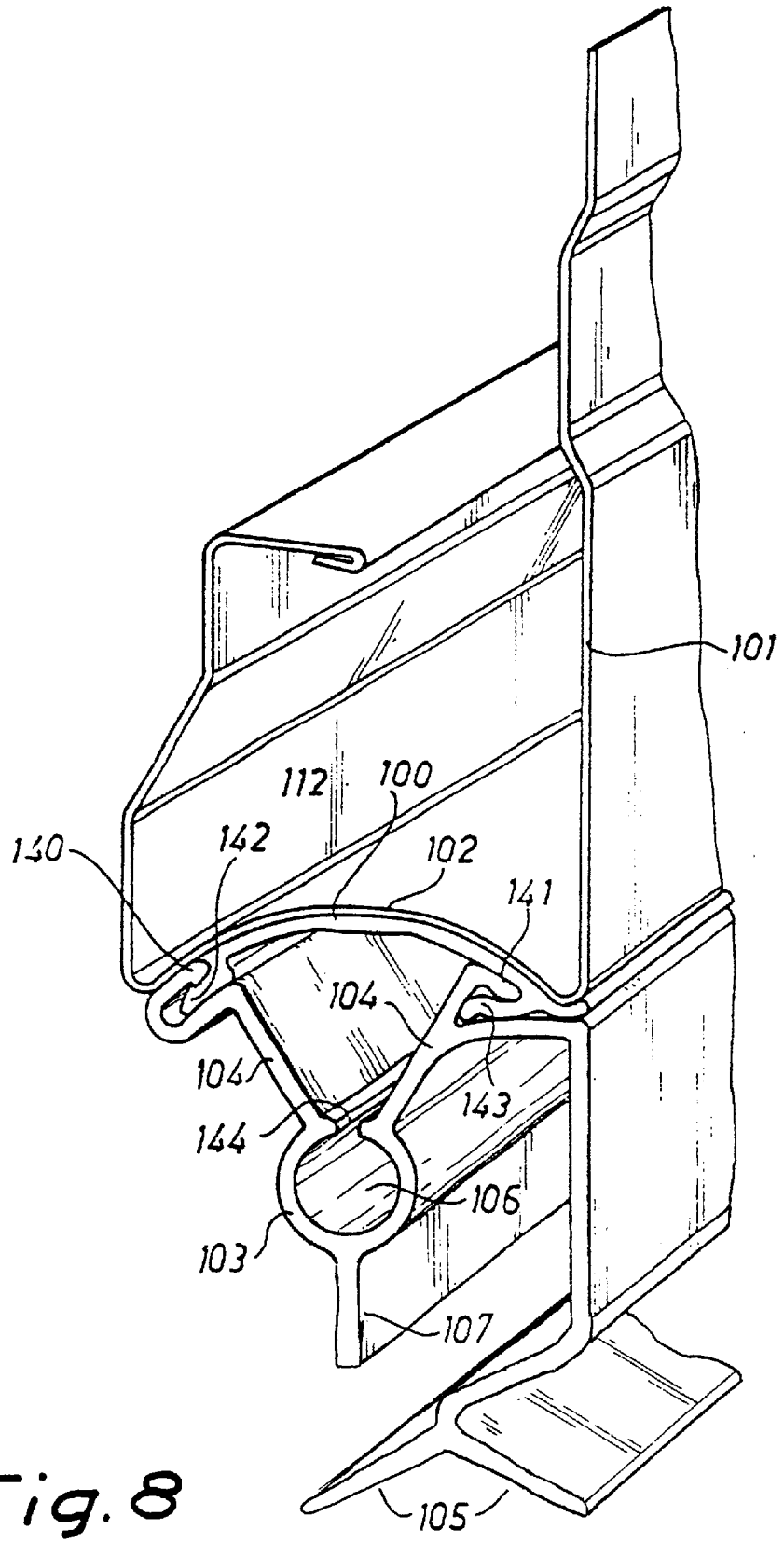
FIG. 8 illustrates one embodiment of a bottom seal to be used with the device in accordance with FIGS. 2–4.

FIG. 8 shows one example of such a bottom, seal. The bottom seal is formed with at least one interconnection piece 100 which is attached to the downwardly facing concave member 102 of the lowermost door panel 101 of the door. The piece 100 preferably is pop-riveted to the concave member 102 and it is manufactured from a material possessing a comparatively high torsional strength, such as aluminum. The piece 100 may extend along essentially the entire concave member 102 but preferably several pieces 100 spaced along the concave member 102, may be used.

The bottom seal also comprises a sealing member 103 extending essentially along the entire concave member 102 and attached to the interconnecting element 100. In accordance with the illustrated, preferred embodiment the sealing member 103 is snap-fitted onto the interconnecting element 100.

Preferably, the sealing member is a two-piece member, the first part 104 of which, being of material having a comparatively high degree of torsional strength, is snap-fitted onto the interconnecting element 100, and at least a second part 105 of which comprises one or several lip seals made from a comparatively flexible material in sealing engagement against the floor or the support when the door is in its lower position.

The first part 104 comprises, in accordance with the embodiment shown, in its upper region a first and a second snap means 140 and 141, respectively. The interconnecting element 100 is former, in accordance with the embodiment illustrated, with respectively a first and a second hook means 142 and 143. The first snap means 140 is in snap-fit engagement with the first hook means 142 and the second snap means 141 is in snap fit engagement with the second hook means 143. In accordance with the shown embodiment the first and the second snap means 140 and 141 are formed with one opening each for reception of the associated hook means 142, 143, said openings being oriented essentially in the sale direction. Owing to this arrangement it becomes possible, by turning the sealing member 103 clockwise in accordance with the example illustrated in FIG. 8 is, to attach the sealing member to the interconnecting element 100 by snap-fitting it thereto. This construction makes it easy to attach the sealing member 103 to the interconnecting element 100. Since the snap means 140 and 141 and the hook means 142 and 143 have their lateral faces in abutting relationship in the area of the corresponding snap-fit connection, a durable joint is also created.

The sealing member 103 is also formed with a recess 106 arranged to receive a pivot shaft, for instance the pivot shaft 40 illustrated in FIG. 2, which extends through the lower hole 38 in an end piece 22. In accordance with the preferred example illustrated, the recess 106 is formed with an opening 144 allowing the recess 106 to absorb tolerance variations between the pivot shaft and the recess.

Below the recess 106 the sealing member 103 is formed with a stop means 107 arranged for contact with the floor or the support when the door is being lowered, preferably via a lip seal 105 or through direct contact.

When a lip seal 105 is provided between the stop means 107 and the floor or support in the lower, closed position of the door an excellent sealing effect is achieved while at the same time the stop means 107 will not be exposed to wear from the floor or the support.

Preferably, the stop means 107 extends along essentially entire seal member 103 and in the closed position of the door it serves as the lowermost impact-absorbing part of the door relatively to the floor or support. Without the provision of the means 107 the lower lug 36 of each lowermost end piece 22 would run the risk of braking upon its contact with the floor or the support, but since the lower part of the stop means 107 projects below the corresponding lug 36 this risk is obviated.

In accordance with the preferred embodiment the first and second parts 104 and 105 of the sealing member 103 are manufactured from co-extruded plastics.

Preferably the bottom seal in FIG. 8 is used in connection with a door panel in accordance with FIGS. 1–4 but it goes without saying that a bottom seal of this type could also be used in connection with differently designed door panels.

Sealing strips 66–68 may be attached along the guide tracks 44, 46 in FIG. 1, preferably by means of a snap-fit arrangement, in order to provide a crush-free transition between the door panel and the guide track.

As appears from FIG. 2, the lug 24 is spaced a distance t from the rest of the end piece 22. In the assembled condition of the door the lug 34 is positioned between the lug 24 and the end piece 22 in the gap formed because of the spacing t of the lug 24 from the end piece 22. By arranging for a smaller spacing in the end pieces 22 at one side of the door and a larger spacing in the end pieces 22 at the opposite side of the door any tolerance variations that may arise during manufacture and assembly will be absorbed by the larger spacing, while the smaller spacing chill ensures that the door panels are interlocked and prevented from moving in the direction of pivot axis 32, 34.

In accordance with one embodiment the lug 36 is formed on at least one of its lateral faces with a first bead (not shown) which is centered about the opening 38 and of essentially circular shape. The lug 24 and/or the end piece 22 of a neighbouring door panel 12 is in this case formed with the second bead (not shown) which is centered about the hole 26 and/or the hole 27 and which is arranged on a lateral face contacting the first bead when neighbouring door panels are in their assembled condition. The second bead is formed with an interior face essentially in the shape of an arc of a circle having a radius somewhat exceeding the outer radius of the first bead on the lug 36. The second bead extends through an arc of a circle smaller than 180°, and has an opening directed upwards, towards the contacting first bead when neighbouring panel sections are in parallel relationship.

The beads of the lug 36 and of the lug 24 and/or the end piece 22 in this case serves as a guide facilitating the installation when neighboring door panels are to be locked in position by means of the pivot shafts 40. In addition, the guides have a partly rigidifying effect on the door hinge.

The first bead need not to be circular but could have any shape, as long as it is formed with a contacting surface of essentially circular configuration for contact with the second bead and as long as its configuration allows rotation about the pivot axes 32, 34 of neighboring door panels.

A similar guiding function is obtained if the first bead is formed on the lug 24 and/or on the end piece 22 whereas the second bead instead is formed on the lug 36.

Figure 9:
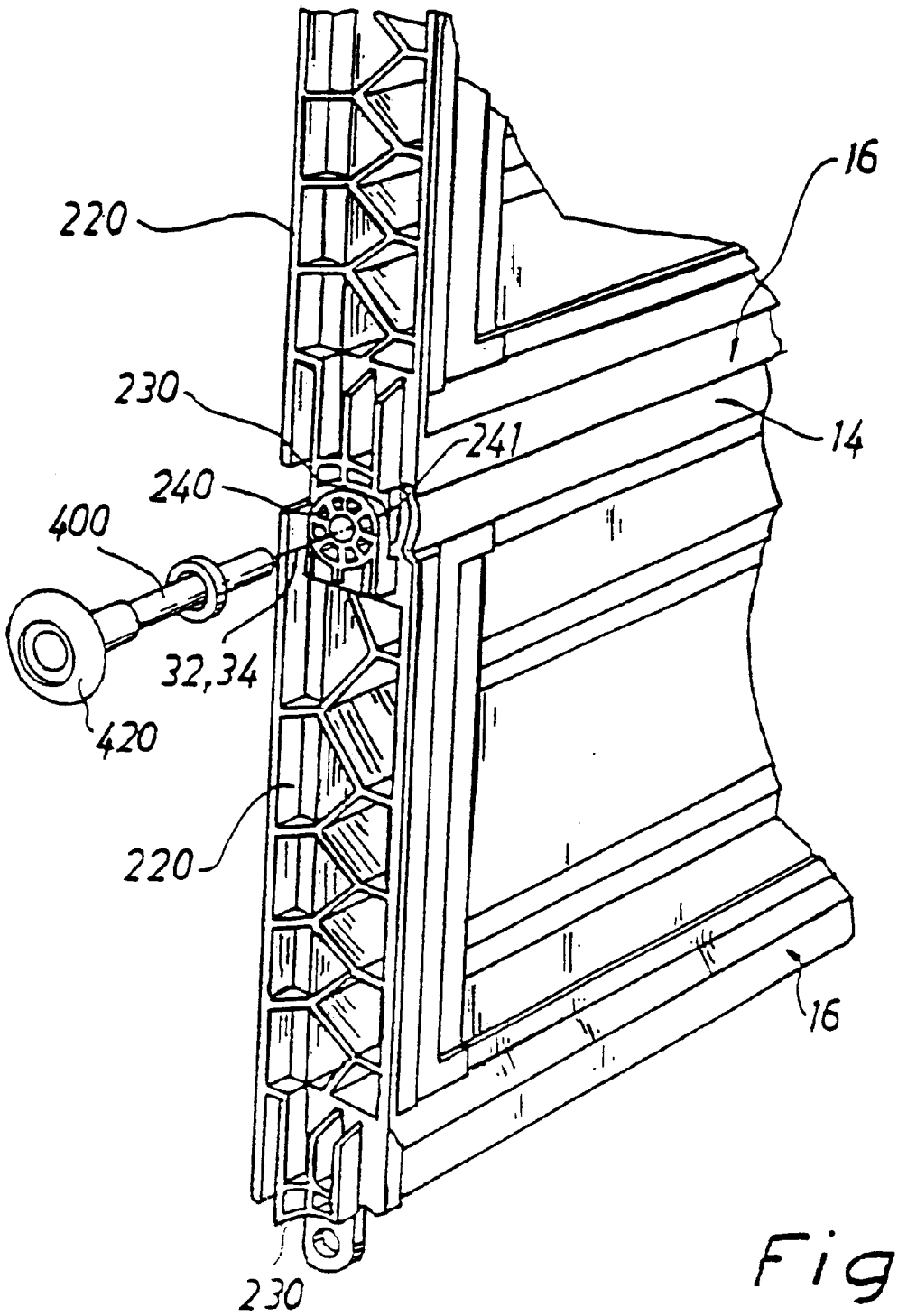
FIG. 9 illustrates an alternative embodiment of an end piece intended for the device in FIGS. 2–4.

FIG. 9 shows an alternative embodiment of an end piece 220. In this case the end piece 220 is provided with a reinforcement member 230 having a configuration which is complementary to that of the lug 240. The external face 241 of the lug 240 and the part of the reinforcement member 230 that is turned towards the face 241 are spaced slightly apart and are curved in correspondance to the radii extending from a common point along the axes 32, 34. Any wear that may cause enlargement of the holes 26, 27 and/or 38 allows the reinforcement member 230 to engage the lug 240, forming a complementary bearing face when neighbouring door panels are being rotated relatively to one another. The reinforcement member 230 also contribute to reducing the risks of crushing injuries when neighbouring door panels move relatively to one another. The reinforcement member 230 also has a rigidifying effect on thee end piece 220.

Because the convex member 20 and the concave member 18 of the device in accordance with the invention are in contact with one another during the entire rotational movement no gaps form that may cause crushing injuries, either on the inner or outer face of the door, between adjoining door panels.

Because of the position of the pivot axes 32, 34 between the lateral walls 28, 30 of the door panel, the convex member 20 and the concave member 18 may be made use of as surfaces serving not only as bearing faces. Thanks to the comparatively large radius of the convex and the concave members 18 and 20, respectively, in combination with the provision of the rigidifying portions 33, 35, 37, 39, 41, 43, 45 adjacent these members 20, 18, the edges 14 and 16, respectively, of the door panels 12 will have a considerable torsionsal strength, allowing them to efficiently absorb flexural stress caused for instance by the effects of wind against the door. As the door is primarily intended to span smaller openings one has found that further guides or similar means on the inner face of the door to absorb forces of this nature are not necessary. In addition, the convex and the concave members 20 and 18, respectively, are able to absorb faces exerted in the direction of movement of the door.

In order to facilitate mounting of the door panels and to increase the strength of the concave member 18 the curvature angle a extends through less than 180°. As a result, the convex member 20 and the concave member 18 need not be snapped together or be inserted one in the other. Another consequence of this arrangement is that the edges 50, 52 of the concave member 18 could, if needed, be less pointed and thus have increased strength.

Because all door panels 12 are of identical configuration they are easy to mount and cost-efficient to manufacture.

The main profile section of the door panel preferably is made from metal. Since the main profile section 51 is manufactured as a continuous profile section in cross-section (see FIG. 3), having only an opening in the side wall 28, it may be easily manufactured by using rolling techniques.

An insulating slab 11 may be positioned in the opening in the side wall 28 in any sitable manner. Owing to the rigidifying portions 33, 35, 37, 39, 41, 43, 45 in combination with the end pieces 22, the locking means and the hinge, the door does, however, become sufficiently rigid to function also when the side walls 28 is opened, and has no insulating slab 11.

Figure 10:
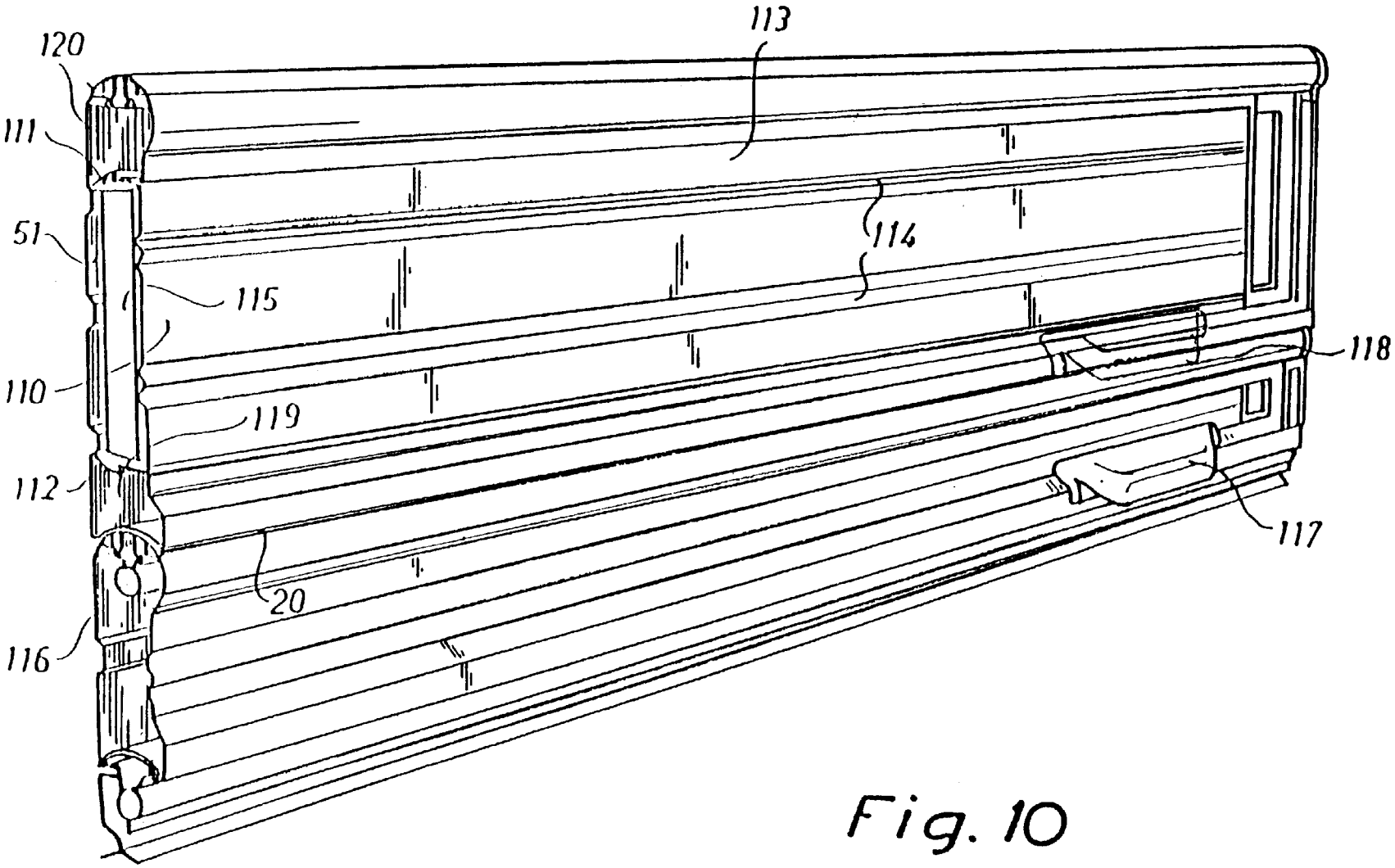
FIG. 10 illustrates an alternative embodiment of an insulating slab and one embodiment of a jointing panel and a handle intended for the device in FIGS. 2–4.

FIG. 10 illustrates the manner in which an insulating slab 110 is attached to a door panel by being snap-fitted onto two snap means 111 and 112. In accordance with the preferred embodiment illustrated in FIG. 10 the insulating slab 110 comprises an outwardly facing decorative panel 113 which could be painted in any suitable colour or be provided with a pattern, such as with lengthwise grooves as indicates by numeral reference 114. The insulating slab 110 also comprises an insulating part 115 which is attached to the decorative panel 113 and/or inserted between the snap means 111 and 112, the latter in turn being attached to or preferably rolled into attachment with the decorative panel 113.

Although it is preferable to arrange a separate insulating slab 110, 11 in door panels having an open side wall and rigidifying portions as illustrated in the embodiments of FIGS. 1–4, 8–9 and 10, it is understood that it is equally possible to use a separate insulating slab in door panels which have an open side of a different appearance than that illustrated in the drawing figures and which could for instance have rigidifying portions of a different configuration or be without such portions.

FIG. 10 also illustrates an example of a jointing panel 116 which by means of pivot shafts and end pieces (not shown) in a similar manner to door panels 12 may be secured to a door. Jointing panels like the jointing panel 116 shown in FIG. 10 has a different height from the other door panels of the door and may be used to adjust the door height. The jointing panel 116 illustrated in FIG. 10 is a closed Profile section and it is the lowermost panel in a door, for which reason it is provided with a bottom seal of the type mentioned in the aforegoing along its lower concave member. However, it should be understood that the jointing panel could also be a profile section that is open on the inner side of the panel to accommodate an insulating slab which could be attached in a manner similar to that described with respect to the door panels above. In addition, the jointing panel 116 could be insulated in some other suitable manner, and could for instance be filled with an insulating material.

FIG. 10 also illustrates an example of a handle 117 which in accordance with the embodiment illustrated is attached to the jointing panel 116. Alternatively a handle 118 illustrated in dash-dotted lines could be secured to a door panel. In accordance with the illustrated preferred embodiment the handle 118 is attached in the area of a channel 119 formed below the insulating slab 110 with the result that the handle 118 could be attached in an identical manner, independently of whether the door panel is equipped with an insulating slab 110 or not. It is understood that a handle could also be attached in the area of a channel 120 formed above the insulating slab 110 with similar results. The handles 117 and 118 preferably also are formed with handle means (not shown) turned towards the external face of the door in order to facilitate operation of a closed door also from the outside by the handle simply being gripped by the hand.

Figure 11:
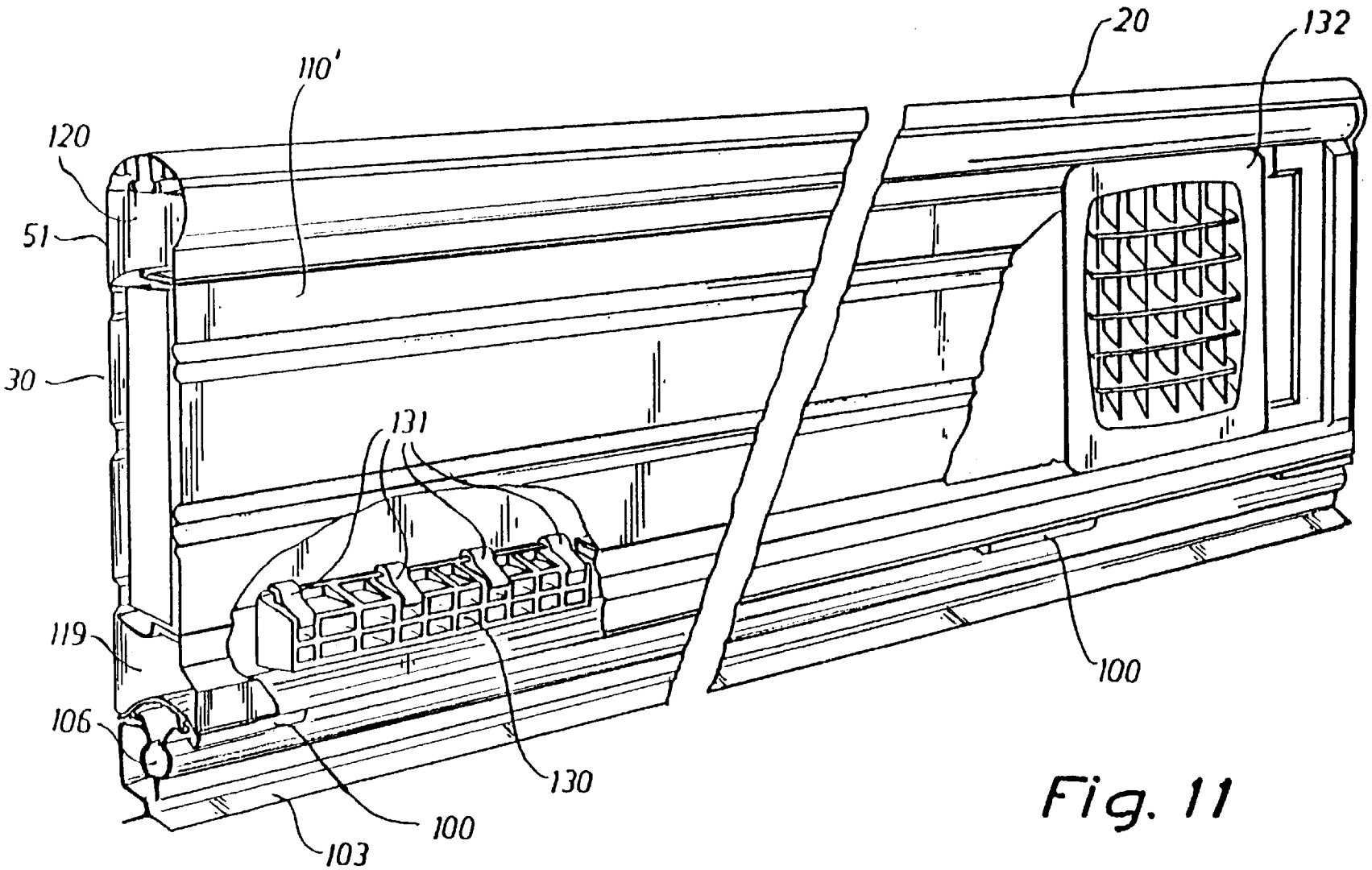
FIG. 11 illustrates in a partly broken view one embodiment of a ventilation arrangement for use with the device in accordance with FIGS. 2–4.

FIG. 11 illustrates one example of a ventilation arrangement in a door panel. The ventilation device comprises at least a first valve 130 formed in an aperture in the lateral wall 30 of the main profile section 51. Said first valve 130 is secured in the aperture, preferably by means of snap means 131. Via the first valve 130 the channel 119 is in combination with the air exteriorly of the door and via a second valve 132, positioned on the inner side c the door panel, it communicates with the air interiorly of the door when the door is closed. This arrangement provides a possibility of ventilation in the door panel. Preferably, the first valve 130 is positioned along channel 119 or alternatively along channel 120 in a door panel, since the channels 119, 120 will not be blocked when an insulating slab 110' is mounted in the door panel. Channels 119 and 120 also make it possible to attach respectively the first valve 130 and the second valve 132 independently of each other along the channels 119, 120, which adds to the versatility of the device.

In accordance with the embodiment illustrated in FIG. 11, the valve 132 is attached in the area between channels 119 and 120, and in this case the insulating slab 110' is configured in a suitable manner to accommodate the valve 132, allowing air to flow between the channel 119 and the space interiorly of a closed door, via the valve 132. Preferably, the valve 132 is snap-connected to the door panel. Obviously, it is quite possible to attach a valve to the inner lateral wall of the door panel in an opening formed in the area of channel 119, in which case there is no need to re-shape the insulating slab to accommodate a valve.

Since the convex member 20 in FIGS. 2 and 3 is removably attached along the edge 14, it is possible to replace it, should the need arise, to avoid that any damages caused by wear, such as scratches, discoloring and the like in the area of the hinges, become visible when neighboring door panels are being turned relatively to one another. Also other wear-exposed components are simple to replace because of the predominant use of snap-connections.

The components in the door arrangements are few in number and a minimum of tools are needed to assemble and mount the door, making the door arrangement cost-efficient to manufacture and well suited for automated assembly, in addition to which it is also easy to mount.

Figure 5:
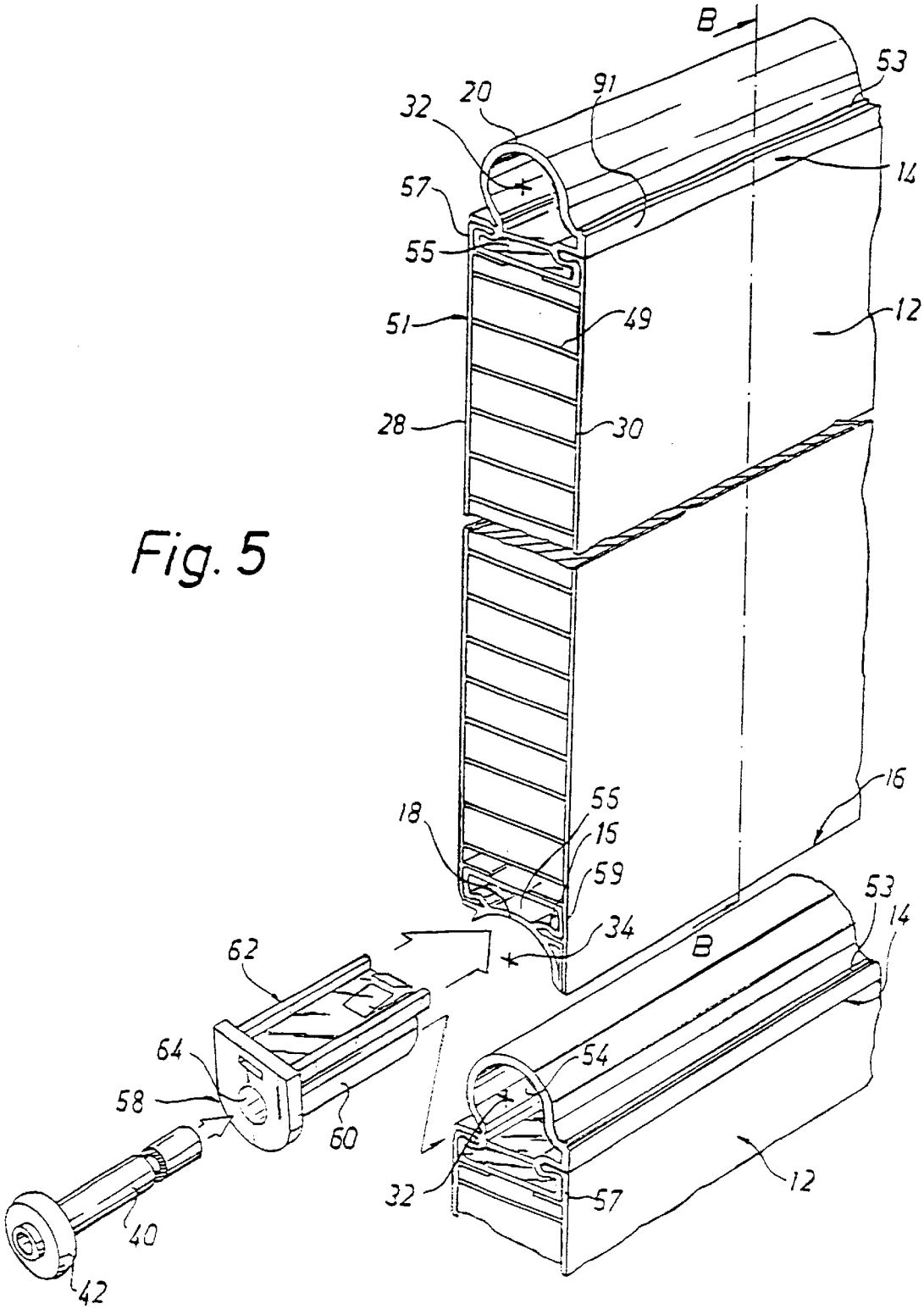
FIG. 5 is an explosive view of a second embodiment of the device in accordance with the invention.

A further embodiment of the invention is shown in FIG. 5. Components corresponding to similar or identical parts in other drawing figures have received the same reference numerals. This embodiment functions in principally the same manner as the one described in the aforegoing and it is primarily intended for doors spanning larger openings than doors in accordance with the embodiment described with reference to FIGS. 1–4 and FIGS. 8–10.

In this embodiment the inner side wall 28 as well as external side wall 30 are configured as closed profile sections. The main profile section 51 is manufactured from one inner and one outer side wall, which preferably is manufactured from metal, and the profile section 51 is filled with a spacer material 49 which jointly with the surface material has a rigidifying and insulating effect.

Along the edges 14, 16 rails 57, 59 are provided. The convex member 20 is pushed into the upper rail 57 of one door panel 12. The concave member 18 of the same panel 12 is pushed into the lower rail 59. Both the convex and the concave members 20 and 18, respectively, are secured preferably in one single point of attachment only (not shown) along the length of each rail 57, 59 to prevent sliding movements or the members along the rails. For instance, pop-riveting may be used to secure the members. Just like in the first embodiment the axes 32, 34 are common to the convex member 20 and the concave member 18 of adjacent door panels, said axes coinciding with the pivot axis.

Figure 6:
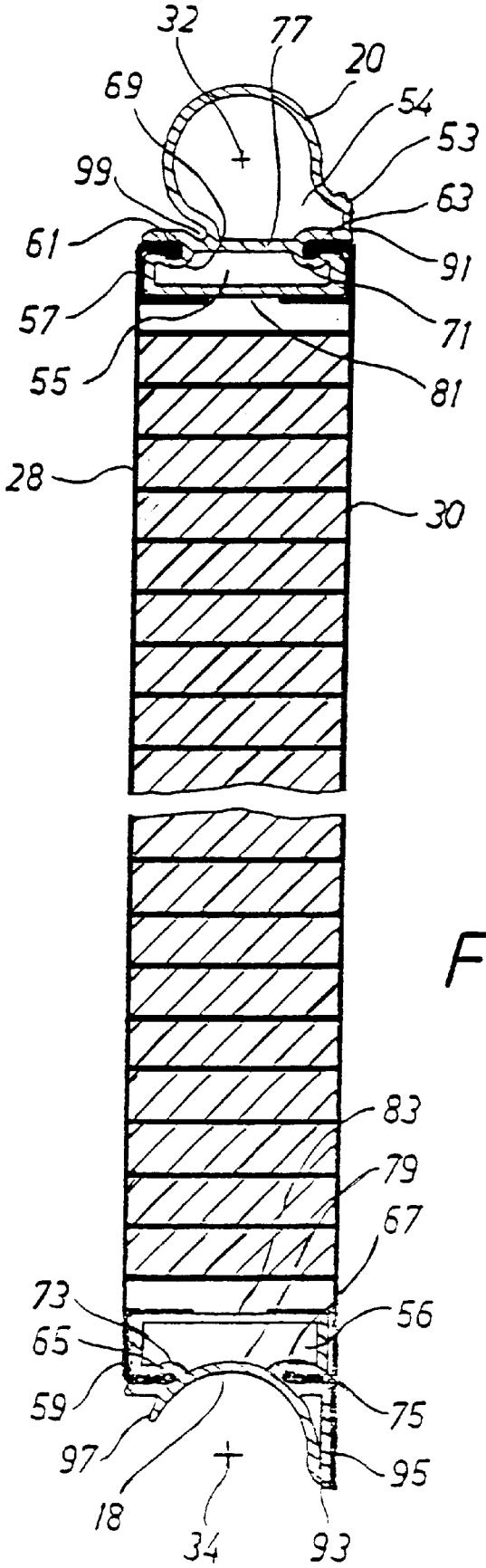
FIG. 6 is a sectional view along line B—B in FIG. 5.

As appears from FIG. 6 beads 61, 63 and 65, 67 are provided on respectively the rails 57 and 59, and the convex member 20 and the concave member 18 are formed with recesses 69, 71 and 73, 75, respectively, matching said beads. Webs 77 and 79 interconnect the recesses 69, 71 and 73, 75, respectively. In this case the rails 57, 59 in combination with the webs 77 and 79 form closed profile sections extending along the door panel edges 14, 16, which has a rigidifying effect. The convex member 20 and the concave member 18 are formed with a portion 81 and 83, respectively, the external edges of which but against the respective one of the rails 57 and 59. In accordance with preferred embodiment the portions 81, 83 are essentially rectangular in shape. Because the rails 57, 59 narrowly enclose the entire end sides and at least part of the longitudinal sides of the respective portions 81 and 83 a further rigidifying effect is achieved as also an interconnection arrangement able to absorb load in all directions.

In accordance with a preferred embodiment each portion 81 and 83 is provided with a recess 55, 56, which preferably is essentially rectangular for reasons to be explained below.

In accordance with one embodiment at least one seal may be provided in the area of contact between the upper right-hand part of the rail 57 (see FIG. 6) and the convex member 20. Preferably, the seal extends along the entire length of the door panel, approximately in an area extending from the part above the bead 63 outwards towards the lateral wall 30 along the surface of contact between the convex member 20 and the upper right-hand part of the rail 57. The seal prevents moisture and dirt from penetrating from the outside into the recess 71.

Figure 12:
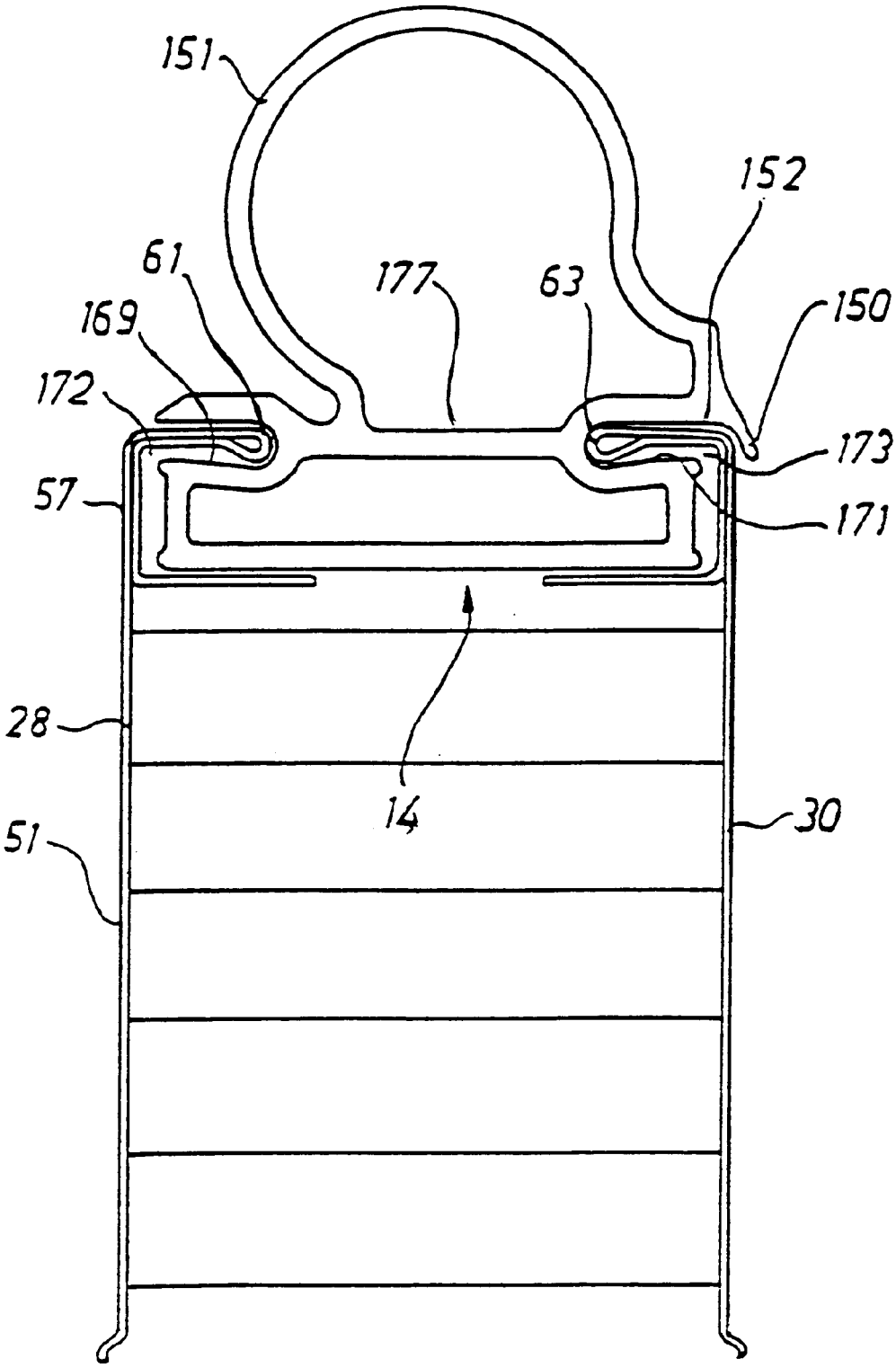
FIG. 12 illustrates one example of a sealing arrangement intended fcr the device illustrated in FIGS. 5–7.

An example of such a seal 150 used in connection with the convex member 151 is shown in FIG. 12. Owing to the provision of the seal 150 the risk that water, dirt and the like is sucked in between the convex member 151 and the main profile section 51 in an area 152 is reduced.

The convex member 131 shown in FIG. 12 is formed with recesses 169, 171 for reception of the beads 61 and 63, respectively, which recesses are somewhat differently shaped from those in accordance with the embodiment in FIG. 6. As appears from FIG. 12 the recesses 169 and 171 are comparatively open in the areas 172 and 173 facing the side walls 28 and 30 respectively of the main profile section 51. This arrangement facilitates assembly and dismantling of the convex member 151 from the main profile section 51. As appears from FIG. 12, each recess 169, 171 tapers in the direction towards the opening at the areas 172, 173. As a result, the beads 61, 63 are to some extent prevented from being displaced laterally, away from one another, since they are partly retained in position by the wedging effect exerted by the recesses 169, 171 and by the web 177.

FIG. 12 also shows the configuration of the door panel lateral walls 28 and 30 in order to form the associated beads 61 and 63, respectively. The configuration preferably is achieved by rolling of the sheet metal from which the lateral walls are formed.

A corresponding sealing arrangement (not shown) may be obtained in a similar manner in the area where the upper left-hand part of the rail 57 shown in FIGS. 5–6 contacts the convex member 20.

At least one seal (not- shown) may also be provided in the area where the lower left hand and right-hand portions of the rail 59 (see FIG. 6) contact the concave member 18. In this case, the seal is arranged in an area extending from the parts underneath the beads 65 and 67, towards the side walls 28 and 30, along the surface of contact between the concave member 18 and the lower portion of the rail 59.

Instead of or in combination with the seal in the area of the upper right-hand part of the rail 59 a seal (not shown) may be provided in the area between the arm 95 and the concave member 18.

Said seals preferably are co-extruded with respectively the convex member 20 and the concave member 18 but could they also be provided on the rails 57 and 59 and/or on the arm 95.

A locking member, generally designated by 58, projects by means of a first portion 60 into a recess 54 formed in the convex member 20 in the assembled condition of the door. The recess 54 and the first portion 60 form a support face and along said face they have a complementary configuration, being essentially cylindrical along said face and centered about the pivot axis 32, 34.

The locking member 58 also has a second portion, generally designated by 62, projecting into a recess 56 formed in the door panel above. The second portion 62 and the recess 56 are of complementary configuration, thus being non-rotationally interconnected.

The locking member 58 thus is rotationally mounted about the pivot axis 32, 34. The locking member 58 interlocks neighboring wall panels while at the same time serving as an additional support face inside the convex member 20, an arrangement which has a rigidifying effect on the hinge. The locking member 58 preferably is manufactured from low friction injection molded plastics.

Figure 7:
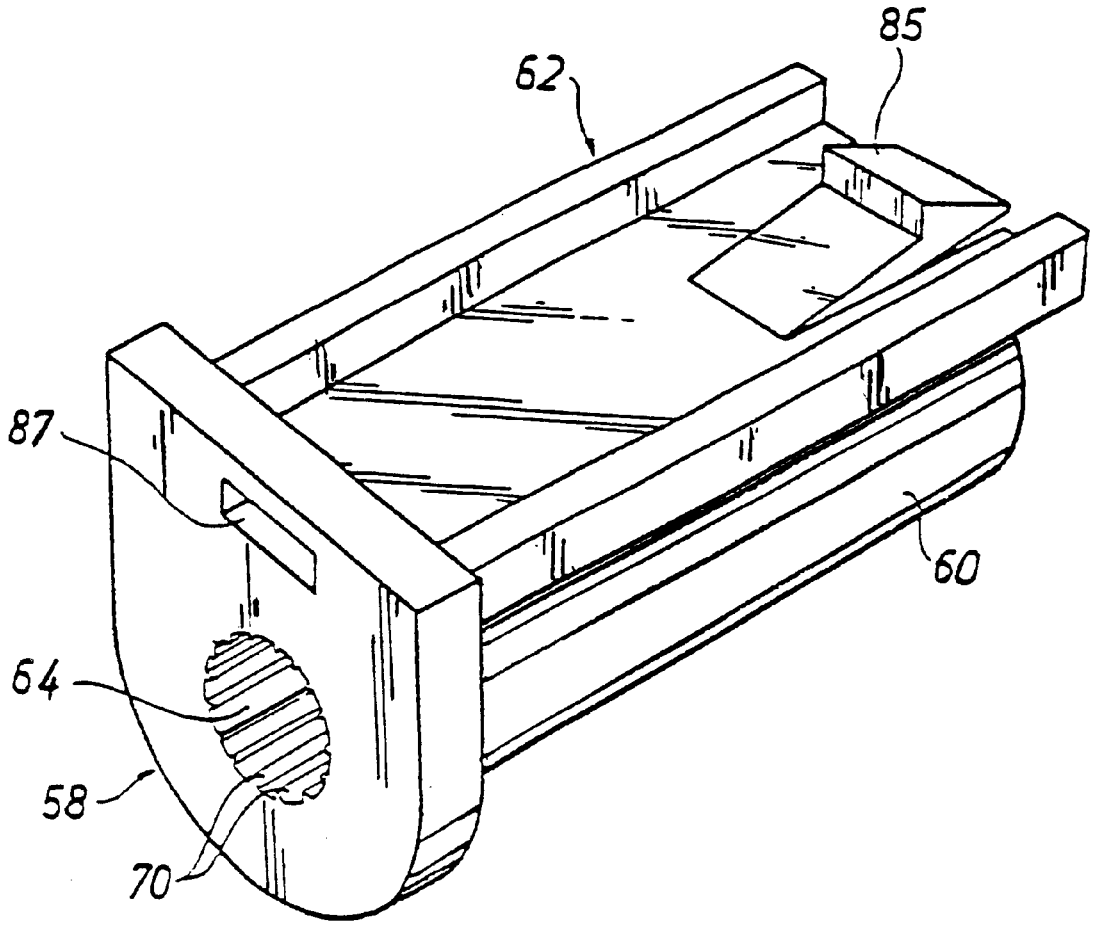
FIG. 7 shows one component of the embodiment of FIG. 5 on an enlarged scale.

As appears from FIG. 7 the second portion 62 of the locking member 58 may comprise a hook 85 which is snap-fitted into a corresponding recess (not illustrated) formed inside the rail 59. The side of the locking member 58 facing the guide track 41, 46 could also have a recess 87 positioned in such a manner that by means of a suitable tool, such as a screwdriver, an operator may conveniently loosen the hook 85 from the outside to allow dismantling of the door panels.

A pivot shaft 40 projects, preferably in a rotatably manner, into a recess 64 in the first portion 60. The pivot shaft 40, which preferably is cylindrical and manufactured from metal, is centred about the pivot axis 32, 34. Like in the embodiment described above the pivot shaft 40 will extend along the Divot axis 32, 34.

As illustrated in FIG. 7 the recess 64 could be formed with longitudinally extending ribs 70 which project radially and resiliently support the pivot shaft 40. The ribs 70 may then absorb differences caused by thermal expansion as may arise between the locking member 58 and the pivot shaft 40 when these two components are manufactured from different materials possessing substantially different thermal expansion properties.

Like in the embodiment above a roller 42 is centred and preferably rotatably mounted on the end of the pivot shaft 40 facing away from the door panel.

The convex member 20 is formed with a bead 91 which preferably extends along the entire lengthwise extension of a door panel in the area of the external wall 30 of the panel. The concave member 18 is formed with an edge face 93 abutting against the bead 91, when neighboring door panels are disposed in parallelism. The bead 91 and the edge face 93 thus make mutual rotation of neighbouring door panels in the direction towards the external face of the door difficult when the panels are parallel. Because the bead 91 and the edge face 93 are spaced a small distance from respectively the convex surface and the concave surface there are no risks of crushing injuries from the bead 91 and the edge surface 93 when neighbouring door panels are being pivoted relatively to one another. A seal 53, preferably manufactured from a resilient material and preferably being co-extruded with the convex member 20, may be provided for this member 20 in the area of the external side wall 30 of the door panel. The seal 53 extends along the convex member 20 and is in sealing contact with the corresponding edge surface 93 when neighboring door panels are parallel.

An arm 95, which preferably is a prolongation of the outer lateral wall 30 of the door panel, abuts according to one embodiment against the external face of the concave member 18, thus covering the external face of concave member 18 which may be sensitive to ultraviolet radiation, and to some extent it also has a rigidifying effect. A more homogeneous appearance thus is imparted to the outer lateral wall 30 of the door panel. In addition, cleaning of said wall is facilitated and the risk that moist may penetrate between the lower portion of the lateral wall 30 and the concave member 18 is reduced.

A recess 99 is formed on the inner face of the convex member 20 for receiving a portion 97 formed on the inner face of the corresponding concave member 18 when the members are being rotated relatively to one another.

Also in accordance with this embodiment the convex member 20 and the concave member 18 form a hinge that is entirely squeeze-injury safe. Like in accordance with the previous embodiments the convex member 20 preferably is disposed above the concave member 18, when the door panels assume a vertical position. Top and bottom seals (not shown) may be provided in respectively the uppermost and lowermost rails instead of a convex member 30 and a concave member 18, respectively. End pieces (not shown) may be provided at the ends of each door panel, serving to cover the panel ends for protection against moisture and dirt.

Because the locking member 58 may interconnect neighboring door panels in a simple manner the number of components required is reduced. Since the locking member 58 also functions as a bearing face together with the recess 54 in the convex member 20 a stiffer hinge, making use of a greater number of bearing faces, is obtained. Also this embodiment permits simple assembly and dismantling, recycling of the various components, and provides possibilities of replacing components that are exposed to wear.

Because the radii of respectively the convex member 20 and the concave member 18 are smaller than in accordance with the first embodiment the door panels are additionally stiffened in the area of the hinge against loads from wind acting on the external face of the door, since the concave member 18 is prolonged all the way down to the edge surface 93.

Owing to the lateral face of the locking member 58 being directed away from the door panel in parallel with the roller 42 it functions as the low-friction spacer, reducing the friction between the roller 42 and the door panel.

The convex member 20 and the concave member 18 may be inserted into the respective one of tracks 57, 59, which provides considerable possibilities of adapting the properties of these parts, e.g. with respect to color, strength, material thickness, coefficient of friction, resistance to corrosive environmental effects, etc.

Owing to the provision in members 18, 20 of a plurality of recesses 54, 55, 56 one or several of these recesses may if desired have received therein stiffening bars of preferably metal or a fibrous composite material (not shown). In this case the recesses preferably extend along the entire length of the members 18, 20 with through-holes being provided at least in one end of the members 18, 20, allowing the stiffening bars to be pushed into the recesses 54, 55, 56. Also the stiffening bars could be attached to their associated recess, for instance by means of a pop-rivet. In this manner it becomes possible to rigidify the door panels in a simple manner.

Comparatively few components are included in the construction and only a small number of tools is required to assemble them, an arrangement which lends itself to cost-efficient manufacture and installation of this embodiment of the invention.

It is easily understood that it is possible to deviate from the embodiments described. For instance every other door panel could be provided with convex members only, door panels adjoining to these panels then being equipped with concave members 18 only.

The locking member 58 could of course be made stationary in the area of the concave member 18 in a different manner than by means of recess 56. The convex member 20 and/or the concave member 18 in accordance with the second embodiment could also be constructed without respectively the webs 77 and 79.

The portion 97 in accordance with the second embodiment could also be made thicker than illustrated in FIG. 6 for increased strength.

All varieties and modifications comprised by the basic inventive idea should be regarded to be encompassed by the appended claims.

What is claimed is:

1. A device in door arrangements comprising a plurality of door panels having a thickness dimension, edges and edge portions, inwardly facing and outwardly facing side walls, said panels having hinge means and adjacent panels are hingedly interconnected to pivot about pivot axes, said pivot axes of each hinge means being positioned in between planes defined by the side walls of adjacent door panels, said hinge means hingedly Interconnecting said adjacent door panels comprising a convex member forming part of one of said door panels and a concave member forming part of an adjacent one of said door panels, said convex and concave members extending along the edges of the door panels, and said concave and convex members each forming a bearing face for contact between adjacent panels, each door panel has a main profile extending uninterrupted over the entire cross section, taken in the thickness direction of each door panel in the respective edge portion, in that one of the edge portions of the door panel exhibit a curved section extending in the thickness direction which defines said concave member, that the door panels have rigidifying portions arranged in the edge portion of the door panel, and in that one of said rigidifying portions Is formed in an Inwardly facing side wall of the door panel and having a cylindrical face, said cylindrical face and said convex member having coinciding pivot axes, wherein the bearing face of the convex member has an extension along a radius which, calculated from the pivot axis, exceeds the radius along which the rigidifying portion is arranged.

2. A device as claimed in claim 1, wherein the inwardly facing side wall (28) of the door panel (12) is at least partly open.

3. A device as claimed in claim 2, wherein the rigidifying portions (33, 35, 37, 39, 41, 43, 45) extend along said inwardly facing side wall (28) of the door panel (12).

4. A device as claimed in claim 3, wherein the rigidifying portions (33, 35, 37, 39, 41, 43, 45) are formed integrally with said side wall (28).

5. A device as claimed in any one of claim 4, wherein an insulating plate (11) is arranged in the opening in said inwardly facing side wall (28) of the door panel (12).

6. A device as claimed in claim 5, wherein the main profile (51) of the door panel (12) is manufactured from a profile exhibiting an opening in and along said inwardly facing side wall (28) of the door panel (12).

7. A device as claimed in claim 6, wherein that the main profile (51) is manufactured by using rolling techniques, and is metal.

* * * * *